US012595614B2

(12) United States Patent
Jo et al.

(10) Patent No.: US 12,595,614 B2
(45) Date of Patent: Apr. 7, 2026

(54) CLOTHES TREATMENT APPARATUS

(71) Applicant: SAMSUNG ELECTRONICS CO., LTD., Suwon-si (KR)

(72) Inventors: Geonhui Jo, Suwon-si (KR); Byeongwoo Kim, Suwon-si (KR); Doyun Lee, Suwon-si (KR); Kwangmin Chun, Suwon-si (KR); Jonghun Sung, Suwon-si (KR); Youngchul Jo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 94 days.

(21) Appl. No.: 18/629,143

(22) Filed: Apr. 8, 2024

(65) Prior Publication Data

US 2024/0254676 A1 Aug. 1, 2024

Related U.S. Application Data

(63) Continuation of application No. PCT/KR2022/013295, filed on Sep. 6, 2022.

(30) Foreign Application Priority Data

Oct. 26, 2021 (KR) ..... 10-2021-0143751

(51) Int. Cl.
*D06F 39/02* (2006.01)
*D06F 23/04* (2006.01)
*D06F 39/12* (2006.01)

(52) U.S. Cl.
CPC ..... *D06F 39/02* (2013.01); *D06F 23/04* (2013.01); *D06F 39/12* (2013.01)

(58) Field of Classification Search
None
See application file for complete search history.

(56) References Cited

U.S. PATENT DOCUMENTS 7,481,082 B2 1/2009 Cho et al.
9,732,461 B2 8/2017 Lee et al.
(Continued)

FOREIGN PATENT DOCUMENTS

CN 210122645 U 3/2020
JP 6-63289 3/1994
(Continued)

OTHER PUBLICATIONS

JP 2013048699 A machine translation, Drum-Type Washing Machine, Tobita (Year: 2013).*
(Continued)

*Primary Examiner* — Cristi J Tate-Sims
(74) *Attorney, Agent, or Firm* — STAAS & HALSEY LLP

(57) ABSTRACT

Disclosed herein is a clothes treatment apparatus according to an embodiment including a cabinet, a tub disposed in the cabinet, and a detergent supply device configured to supply detergent into the tub, wherein the detergent supply device includes a housing, a detergent container provided in the housing to accommodate detergent, a water supply guide configured to guide water from a water supply source to the inside of the housing, and a partition configured to cover a portion of the detergent container to prevent water supplied into the housing by the water supply guide from flowing to an upper side of the detergent container.

13 Claims, 14 Drawing Sheets

(56) References Cited

U.S. PATENT DOCUMENTS

| | | | | |
|---|---|---|---|---|
| 9,879,370 | B2 | 1/2018 | Jung et al. | |
| 11,634,852 | B2 | 4/2023 | Choi et al. | |
| 2014/0109620 | A1* | 4/2014 | Yoon | D06F 23/04 68/17 R |
| 2015/0114047 | A1* | 4/2015 | Jung | D06F 39/022 68/17 R |
| 2020/0232146 | A1* | 7/2020 | Jung | D06F 39/02 |
| 2020/0325615 | A1 | 10/2020 | Chae et al. | |

FOREIGN PATENT DOCUMENTS

| | | |
|---|---|---|
| JP | 2013-48699 | 3/2013 |
| JP | 2015-208514 | 11/2015 |
| JP | 2021-58442 | 4/2021 |
| KR | 96-11220 | 4/1996 |
| KR | 1999-003416 | 1/1999 |
| KR | 10-0453783 | 1/2005 |
| KR | 10-2005-0100553 | 10/2005 |
| KR | 10-2013-0048450 | 5/2013 |
| KR | 10-2013-0048451 | 5/2013 |
| KR | 10-2015-0049338 | 5/2015 |
| KR | 10-2032278 | 10/2019 |
| KR | 10-2021-0071559 | 6/2021 |

OTHER PUBLICATIONS

International Search Report, PCT/ISA/210, dated Jan. 2, 2023, in PCT Application No. PCT/KR2022/013295.

Written Opinion, PCT/ISA/237, dated Jan. 2, 2023, in PCT Application No. PCT/KR2022/013295.

* cited by examiner

CLOTHES TREATMENT APPARATUS

CROSS-REFERENCE TO RELATED APPLICATIONS

This application is a continuation of International Application PCT/KR2022/013295, filed Sep. 6, 2022, and claims foreign priority to Korean application 10-2021-0143751, filed Oct. 26, 2021, which are incorporated herein by reference in their entireties.

TECHNICAL FIELD

The disclosure relates to a clothes treatment apparatus, and more particularly, to a clothes treatment apparatus including a detergent supply device.

BACKGROUND ART

In general, clothes treatment apparatuses include washing machines that use a driving force of a motor to rotate laundry and detergent placed in a rotating tub together to wash the laundry by mutual friction, and drying machines that rotate a rotating tub receiving an object to be dried to dry the object in the rotation.

Such a clothes treatment apparatus may include a detergent supply device provided in a cabinet, and the detergent supply device is a device that allows detergent to be supplied inside a tub. For example, if the detergent is liquid, the liquid detergent may be supplied directly into the tub.

The detergent supply device may include a housing and a detergent container disposed within the housing to receive the detergent. The detergent supply device may be supplied with water to mix with the detergent, and a flow path structure may be required to prevent water from flowing to unnecessary areas.

DISCLOSURE

Technical Problem

The present disclosure is directed to a clothes treatment apparatus including a detergent supply device with an improved flow path structure.

Further, the present disclosure is directed to a clothes treatment apparatus including a detergent supply device capable of minimizing mold growth.

Technical Solution

According to an embodiment of the disclosure, a clothes treatment apparatus includes a cabinet, a tub in the cabinet, and a detergent supply device configured to supply detergent into the tub, wherein the detergent supply device includes a housing, a detergent container in the housing and configured to accommodate the detergent, a water supply guide configured to guide water from a water supply source into the housing, and a partition covering a portion of the detergent container to prevent water supplied into the housing by the water supply guide from flowing to an upper side of the detergent container.

The partition may extend from an upper end of the housing to guide water flowing from the water supply guide into the housing.

The water supply guide may be on an upper side of the housing.

The detergent supply device may further include a guide channel between the partition and a rear wall of the housing and communicating with an inside of the water supply guide so that water entering the housing flows to a lower portion of the housing.

The detergent container may further include a container configured to accommodate the detergent, and a detergent container cover configured to cover an upper portion of the container, and the partition may extend downward from the upper end of the housing to prevent water flowing into the housing from flowing to the detergent container cover.

The detergent supply device may further include a detergent pump on a rear of the housing and configured to intake the detergent from the detergent container and discharge the intaken detergent into the housing, a pipe through which the detergent moves from the detergent container to the detergent pump, and a valve for opening or closing the pipe and partially disposed in the guide channel to be washed by water on the guide channel.

A lower end of the partition may be lower than an upper end of the valve.

The guide channel may include a plurality of side channels and a middle channel between the valve and the plurality of side channels, and the water flowing into the guide channel may allow the valve to be washed and then flows into the plurality of side channels or the middle channel.

The clothes treatment apparatus may further include a sealing rib protruding from the partition toward the detergent container to seal a space between the housing and the detergent container.

The sealing rib may correspond to a circumference of the valve to prevent water from splashing onto the detergent container cover.

The water supply guide may include a pipe portion configured to be supplied with water from a water supply source, and a panel portion communicating with the partition at a lower side of the pipe portion to allow water to flow from the pipe portion into the guide channel.

The pipe portion may be provided as a plurality of pipe portions, and the plurality of pipe portions may include a first pipe portion connected to one end along a left-to-right direction of the panel portion, and a second pipe portion connected to another end along the left-to-right direction of the panel portion and located further rearward than the first pipe portion.

The clothes treatment apparatus may further include a top cover including an inlet at an upper portion of the top cover through which an object to be washed is receivable into the tub, wherein the detergent supply device is above the tub to allow the detergent container to be pulled in from or out of the inlet.

According to an embodiment of the disclosure, a clothes treatment apparatus includes a cabinet, a tub in the cabinet, and a detergent supply device configured to supply detergent into the tub, wherein the detergent supply device includes a housing, a container in the housing and configured to accommodate the detergent, a detergent container cover covering an upper portion of the container, a detergent pump to which the container is dockable, the detergent pump configured to intake the detergent from the container and discharge the intaken detergent into the housing based on the container being docked to the detergent pump, a water supply guide communicating with the housing to supply water from a water supply source into the housing, and a partition communicating with the water supply guide and extending from an upper end of the housing to prevent water supplied into the housing through the water supply guide from flowing into the detergent container cover.

The water supply guide may be on an upper side of the housing, and the partition may extend downwardly from the upper end of the housing to allow water supplied into the housing through the water supply guide to flow to a lower portion of the housing.

According to an embodiment of the disclosure, a clothes treatment apparatus includes a main body having an inlet disposed at an upper portion thereof, a tub disposed within the main body and having an opening disposed at an upper portion thereof, and a detergent supply device disposed above the tub, wherein the detergent supply device includes a housing, a detergent container provided in the housing to accommodate detergent and configured to be to be pulled in from or out of the inlet, a water supply guide forming a water supply channel in communication with the interior of the housing for supplying water from a water supply source to the interior of the housing, and a flow guide provided within the housing to form a guide channel connected to the water supply channel to guide water flowing from the water supply channel to a lower portion of the housing.

The detergent supply device may further include a detergent pump disposed on a rear side of the housing and configured to intake detergent from the detergent container and discharge the intake detergent into the housing, and the flow guide may be formed at a rear side of the housing to be disposed between the detergent container and the detergent pump along a front-to-back direction.

The detergent supply device may further include a pipe through which the detergent moves from the detergent container to the detergent pump, and a valve for opening or closing the pipe and partially disposed in the guide channel so as to be washed by water on the guide channel, and the flow guide may extend downward from an upper wall of the housing to allow water flowing through the water supply channel and into the guide channel to wash the valve.

The clothes treatment apparatus may further include a sealing rib protruding from a lower end of a front surface of the flow guide to seal a space between the housing and the detergent container and prevent water from flowing into an upper portion of the detergent container.

The guide channel may include a plurality of side channels and a middle channel disposed between the valve and the plurality of side channels, and the water flowing into the guide channel may allow the valve to be washed and then flows into the plurality of side channels or the middle channel.

Advantageous Effects

According to the spirit of the present disclosure, it is possible to provide a clothes treatment apparatus including the detergent supply device in which the flow path is improved to allow water to be directed to a desired location.

According to the spirit of the present disclosure, it is possible to provide a clothes treatment apparatus including in which the flow path is improved to enable mold growth to be minimized.

MODES OF THE INVENTION

Figure 1:
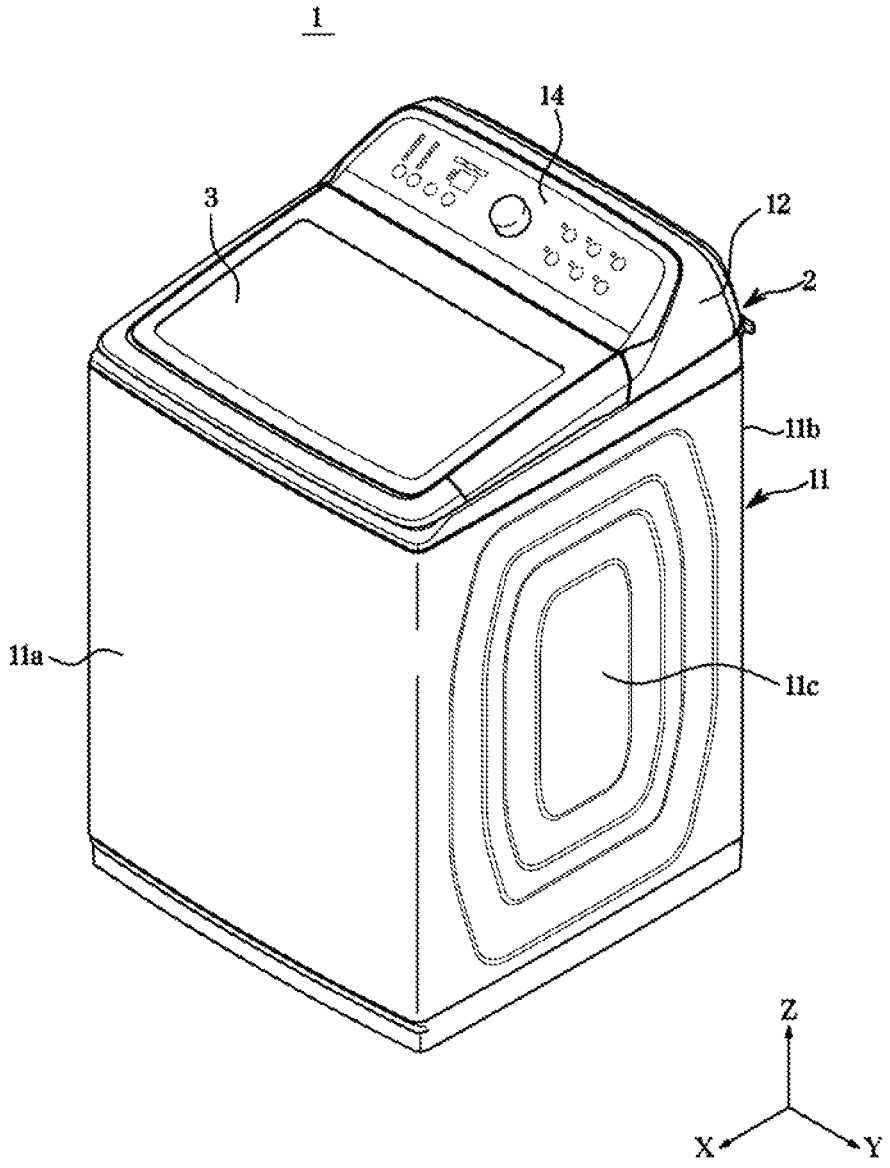
FIG. 1 is a perspective view showing a clothes treatment apparatus according to an embodiment of the present disclosure.

Embodiments described in the disclosure and configurations shown in the drawings are merely examples of the embodiments of the disclosure and may be used in various different ways at the time of filing of the present application to replace the embodiments and drawings of the disclosure.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, figures, steps, operations, elements, components, or combinations thereof, but do not preclude the presence or addition of one or more of the features, figures, steps, operations, elements, components, or combinations thereof.

It will be understood that, although the terms "first", "second", "primary", "secondary", etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

As used herein, the terms "front", "rear", "upper", "lower", "left", "right", and the like are defined with reference to the drawings and are not intended to limit the shape and location of each component.

A clothes treatment apparatus according to various embodiments of the present disclosure may include a washing machine, a dryer, a clothes care appliance, and the like. However, for ease of description, embodiments of the present disclosure will be described below based on a top-loading washing machine.

In addition, detergents may include not only detergents for laundry, but also rinses, deodorants, sanitizers, or air fresheners for dryers.

Hereinafter, various embodiments according to the disclosure will be described in detail with reference to the accompanying drawings.

Figure 2:
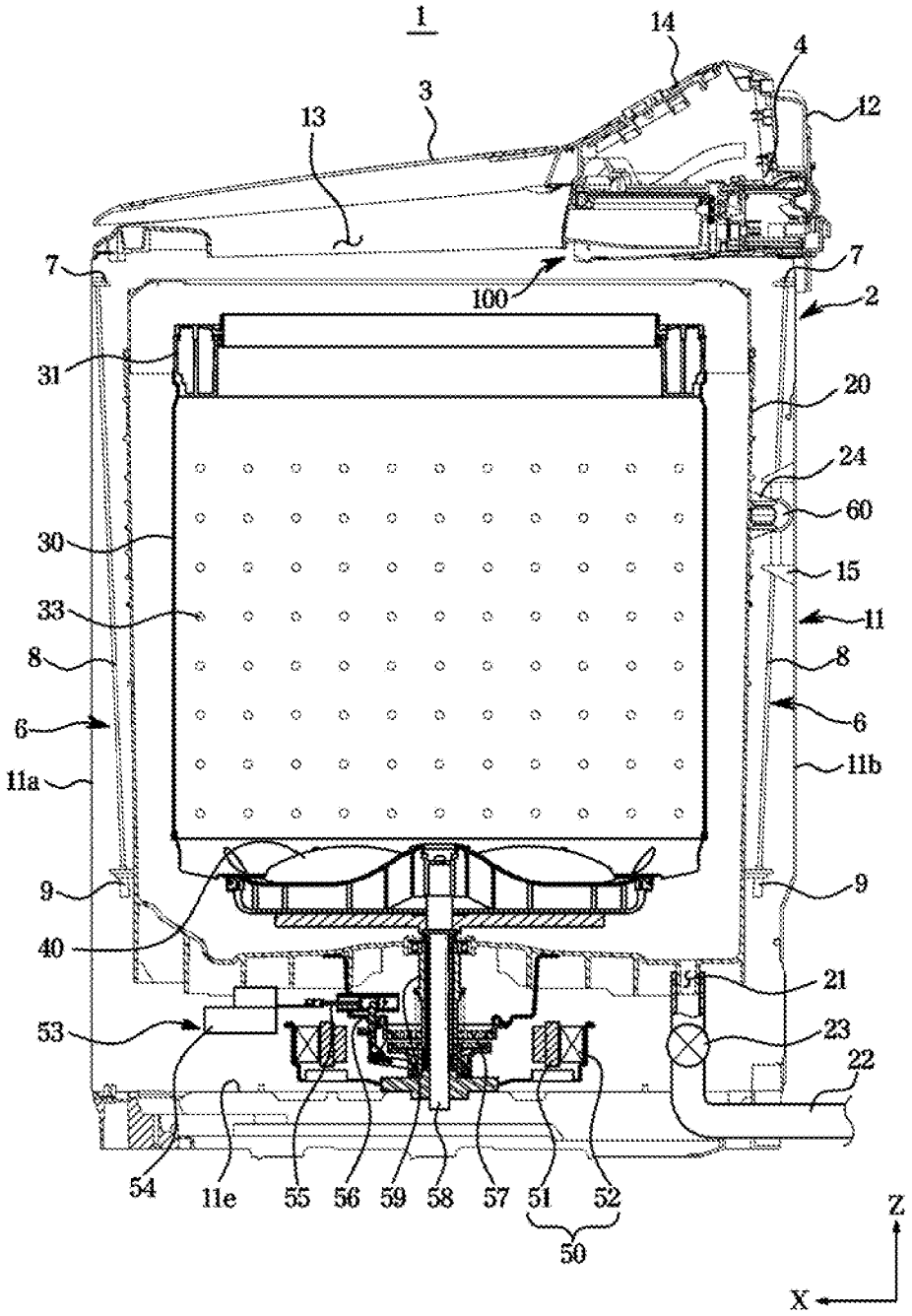
FIG. 2 is a side cross-sectional view of the clothes treatment apparatus shown in FIG. 1.

FIG. 1 is a perspective view showing a clothes treatment apparatus according to an embodiment of the present disclosure. FIG. 2 is a side cross-sectional view of the clothes treatment apparatus shown in FIG. 1.

Referring to FIGS. 1 and 2, a clothes treatment apparatus 1 according to an embodiment of the present disclosure may include a main body 2 forming an exterior thereof, a tub 20 provided within the main body 2 to store water, and a rotating tub 30 accommodating an object, such as an object to be washed or an object to be dried and rotatably provided within the tub 20, and a pulsator 40 rotatably provided within the rotating tub 30 and generating a water current. The pulsator 40 may be shown as being provided at a lower portion of the rotating tub 30, but is not limited thereto.

The main body 2 may include a cabinet 11, and a top cover 12 coupled to an upper portion of the cabinet 11. The top cover 12 may be provided with an inlet 13 through which an object to be washed (i.e., laundry) may be placed in the rotating tub 30, and the inlet 13 may be opened and closed by a door 3. The top cover 12 may be provided with a control panel 14 that displays operating information of the clothes treatment apparatus 1 or receives operating instructions.

The cabinet 11 may have a box shape. In other words, the cabinet 11 may have a front plate 11*a*, a rear plate 11*b*, a left plate 11*c*, a right plate 11*d*, and a bottom plate 11*e*.

The tub 20 may be provided in a cylindrical shape with an open top and may store washing water. The tub 20 may be suspended from the cabinet 11 by suspension devices 6.

The suspension devices 6 may each include a suspension bar 8 extending vertically, a suspension cap 7 provided such that an upper end of the suspension bar 8 is coupled to the cabinet 11 and an lower end of the suspension bar 8 is coupled to the tub 20, and a spring 9 provided at the lower end of the suspension bar 8 to reduce vibration of the tub 20. The spring 9 may reduce the vibration of the tub 20 in a vertical direction.

A drain 21 may be formed in a lower portion of the tub 20 to drain the washing water stored in the tub 20 to the outside of the tub 20. A drain hose 22 may be connected to the drain 21, and a drain valve 23 may be provided on the drain hose 22 to open and close the drain 22.

The rotating tub 30 may be rotatably provided within the tub 20 and may accommodate laundry. The rotating tub 30 may be formed in a cylindrical shape with an open top. A plurality of holes 33 may be formed on a side surface of the rotating tub 30 to allow washing water to flow in and out. A balancing device 31 may 31 may be installed at an upper portion of the rotating tub 30 to eliminate a load imbalance caused by laundry. The balancing device 31 may include a housing having an annular channel and a ball or fluid mass movably provided within the channel. As the balls or fluid moves in accordance with the rotation of the rotating tub 30, the load imbalance may be resolved.

The pulsator 40 may be rotatably provided at the lower portion of the rotating tub 30 to generate the water current. Laundry may be washed by the water current generated by the pulsator 40.

The clothes treatment apparatus 1 may include a water supply device 4 that supplies washing water to the tub 20. The water supply device 4 may include a water supply pipe connected to an external water supply source to guide washing water to the tub 20, and a water supply valve 15 (see FIG. 3) provided in the water supply pipe to regulate the water supply.

The clothes treatment apparatus 1 may include a detergent supply device 100 that supplies detergent. The water supplied through the water supply device 4 may be provided to pass through the detergent supply device, so that the detergent may be supplied to the tub 20 together with the water. In this case, the detergent may include different detergents, such as rinse or softener for dryers as well as detergents for laundry.

The detergent supply device 100 may be provided above the tub 20. The detergent supply device 100 may be disposed on an upper side of the tub 20 to supply detergent into the tub 20 and/or the rotating tub 30. For example, the detergent supply device 100 may be provided on the top cover 12. Furthermore, the detergent supply device 100 may be disposed on a rear side of the top cover 12. The detergent supply device 100 may be withdrawn towards the inlet 13 or may be introduced into the top cover 12 from the inlet 13.

The clothes treatment apparatus 1 may include a drive device for rotating the rotating tub 30 and the pulsator 40.

The drive device may include a motor 50 that converts an electrical force into a mechanical rotational force, and a shaft system that transmits a driving force of the motor 50 to the pulsator 40 and the rotating tub 30.

The motor 50 may include a fixed stator 51 and a rotor 52 that interacts electromagnetically with the stator 51 to rotate.

The shaft system may include a spin-drying shaft 59 provided to transmit the driving force of the motor 50 to the rotating tub 30, a washing shaft 58 provided to transmit the driving force of the motor 50 to the pulsator 40, and a clutch device 53 that connects or disconnects the motor 50 and the spin-drying shaft 59.

The spin-drying shaft 59 may be formed to have a hollow, and the washing shaft 58 may be provided in the hollow of the spin-drying shaft 59. The washing shaft 58 may remain connected to the rotor 52 of the motor 50, and the spin-drying shaft 59 may be connected to or disconnected from the rotor 52 of the motor 50 by the clutch device 53.

When the clutch device 53 disconnects the spin-drying shaft 59 from the motor 50, power may be transmitted only to the washing shaft 58 to allow only the pulsator 40 to rotate, and when the clutch device 53 connects the spin-drying shaft 59 to the motor 50, power may be transmitted to both the spin-drying shaft 59 and the washing shaft 58 to allow the rotating tub 30 and the pulsator 40 to rotate simultaneously.

When the pulsator 40 rotates only, the water current may be generated by the rotation of the pulsator 40, and the laundry may be rotated by the generated water current and rubbed against the rotating tub 30, thereby performing washing of the laundry. When the pulsator 40 and the rotating tub 30 rotate together, the laundry may rotate in the rotating tub 30 and moisture may be removed from the laundry by a centrifugal force, thereby performing spin-drying of the laundry.

The clutch device 53 may include an actuator 54 that generates a driving force for power conversion, a rod 55 that is moved linearly by an action of the actuator 54, a lever 56 that is pivotally connected to the rod 55, and a coupling 57 coupled to the spin-drying shaft 59 to be move vertically in accordance with an operation of the lever 56. When the coupling 57 is lowered, the coupling 57 may be connected to the rotor 52 so that the driving force of the motor 50 may be transmitted to the spin-drying shaft 59, and when the coupling 57 is raised, the coupling 57 may be disconnected from the rotor 52 so that the driving force of the motor 50 may be not transmitted to the spin-drying shaft 59.

Figure 3:
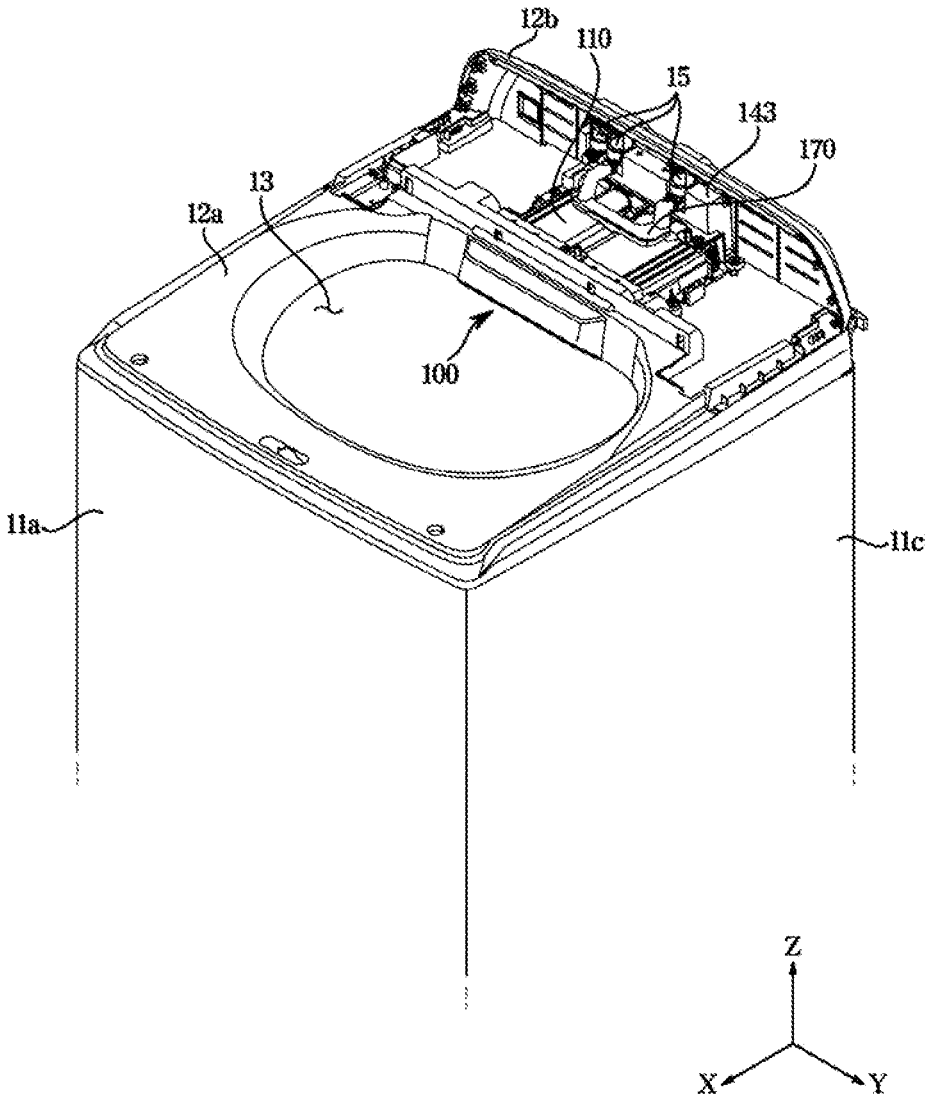
FIG. 3 is a perspective view showing an upper portion of the clothes treatment apparatus shown in FIG. 1.
Figure 4:
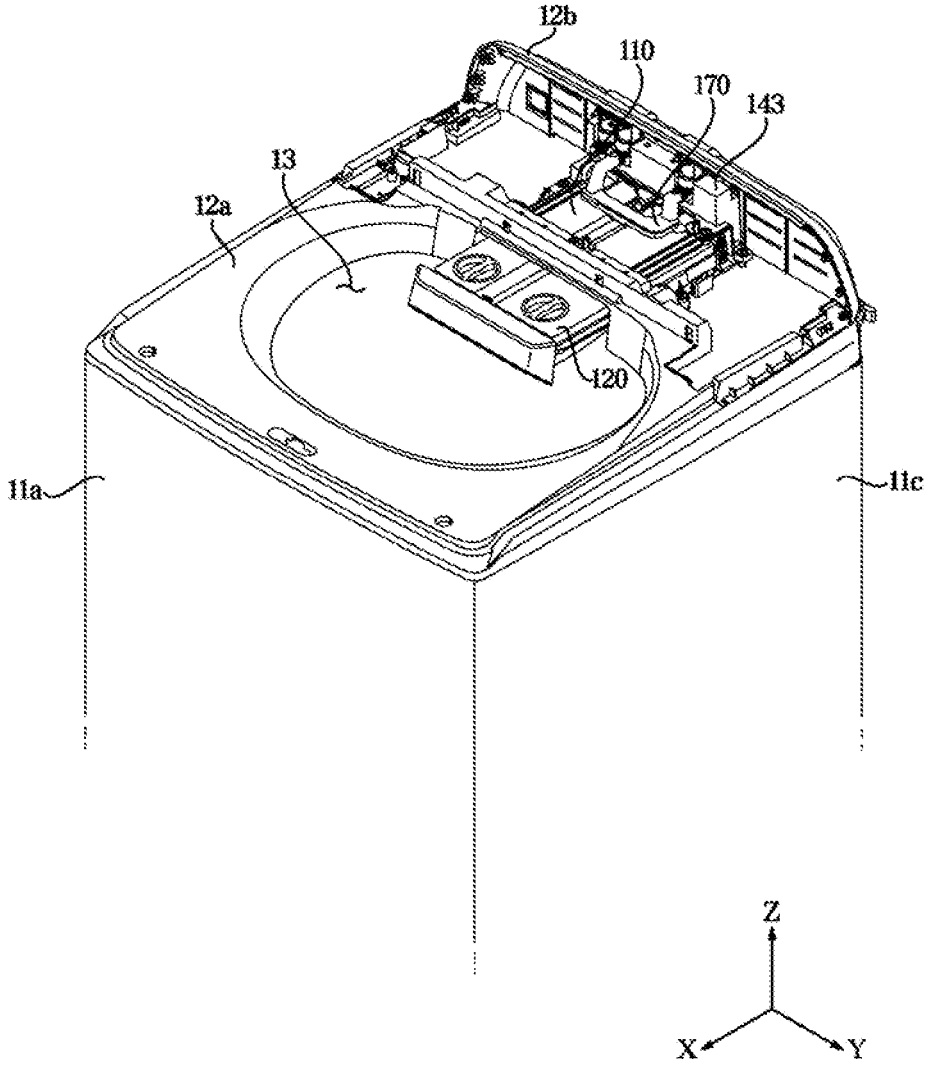
FIG. 4 is a perspective view showing the upper portion of the clothes treatment apparatus shown in FIG. 3.

FIG. 3 is a perspective view showing the upper portion of the clothes treatment apparatus shown in FIG. 1. FIG. 4 is a perspective view showing the upper portion of the clothes treatment apparatus shown in FIG. 3.

Referring to FIGS. 3 and 4, the clothes treatment apparatus 1 according to an embodiment of the present disclosure may include the detergent supply device 100.

The detergent supply device 100 may be provided within the main body 2. For example, the detergent supply device 100 may be provided on the top cover 12 to supply detergent and water into the tub 20 and/or the rotating tub 30. The detergent supply device 100 may be provided on a rear portion 12*b* of the top cover 12. An upper portion of the detergent supply device 100 may be covered by a control panel 14 and/or an upper cover (not shown) of the top cover 12.

To be supplied with water from a water supply source, the detergent supply device 100 may be connected to a water supply pipe (not shown) and the water supply valve 15 that opens or closes the water supply pipe. The water supply valve 15 may be coupled to the top cover 12.

The detergent supply device 100 may be positioned above the tub 20. The detergent supply device 100 may be pulled out from the main body 2 towards the inlet 13. For example, the detergent supply device 100 may be pulled out from the rear portion 12*b* of the top cover 12 towards the inlet 13 and/or a front portion 12*a* of the top cover 12. Furthermore, the detergent supply device 100 may be pulled into the inside of the top cover 12 from the inlet 13. For example, the detergent supply device 100 may be drawn out or into towards the top cover 12 in a front-to-back direction.

The detergent supply device 100 may include a housing 110 and a water supply guide 170 in communication with the housing 110. The water supply guide 170 may guide the water supplied to the clothes treatment apparatus to flow into the housing 110. The interior of the housing 110 may be a water receiving space 111. The water supply guide 170 may be supplied with hot water and/or cold water from the water supply pipe. The water supply guide 170 may be disposed above the housing 110. However, the water supply guide 170 is not limited thereto, and may be disposed on a laterally or underside of the housing 110 to supply water into the housing 110.

The clothes treatment apparatus may further include a pump cover 143 covering a detergent pump 140 (see FIG. 5) of the detergent supply device 100. The pump cover 143 may cover an upper side and a rear side of the detergent pump 140.

Figure 5:
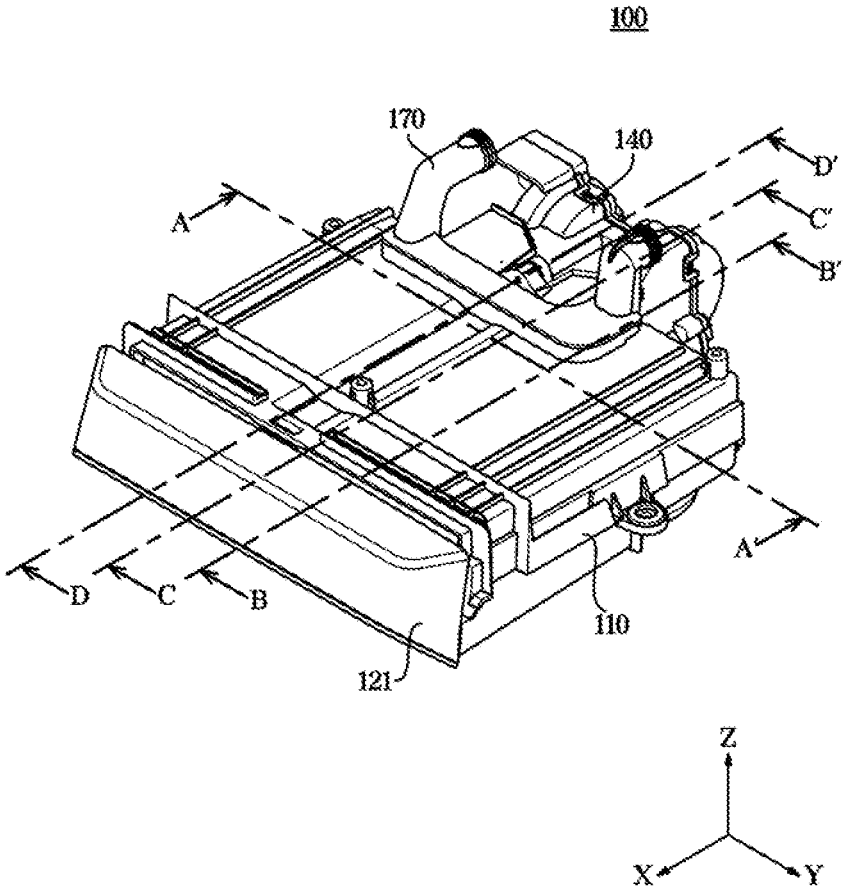
FIG. 5 is a perspective view showing a detergent supply device in the clothes treatment apparatus shown in FIG. 1.
Figure 6:
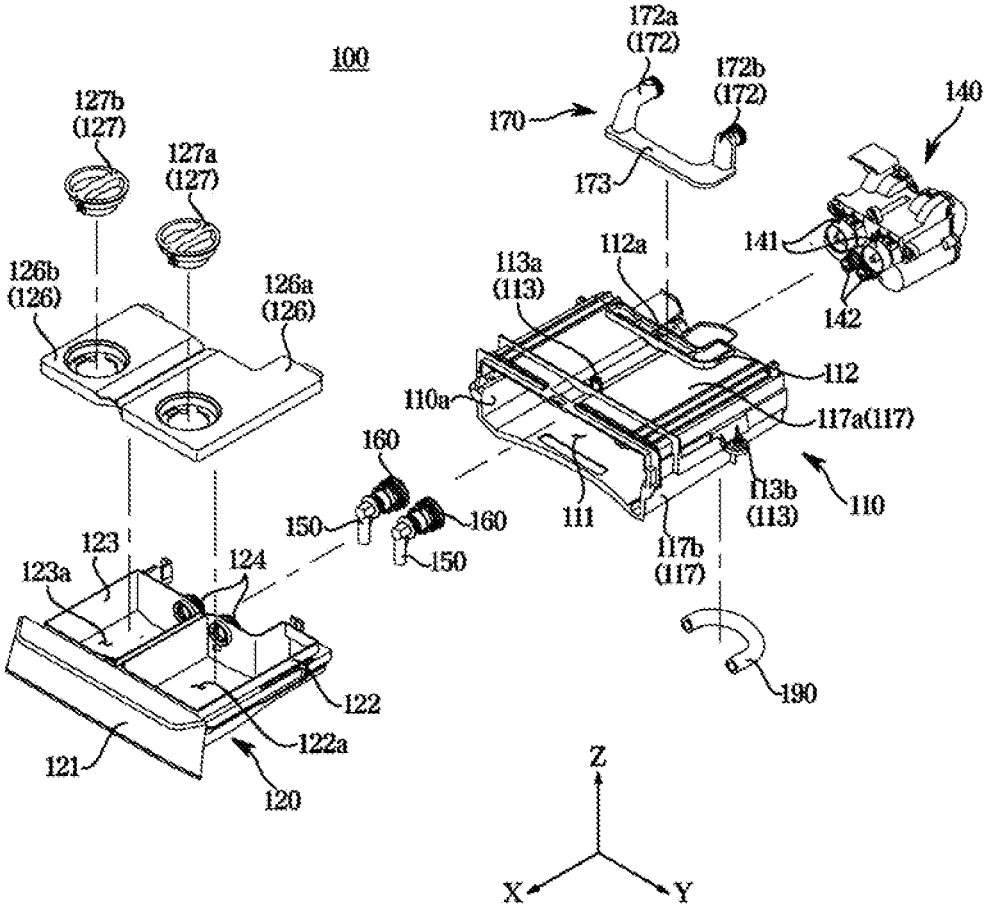
FIG. 6 is an exploded perspective view showing the detergent supply device in the clothes treatment apparatus shown in FIG. 5.
Figure 7:
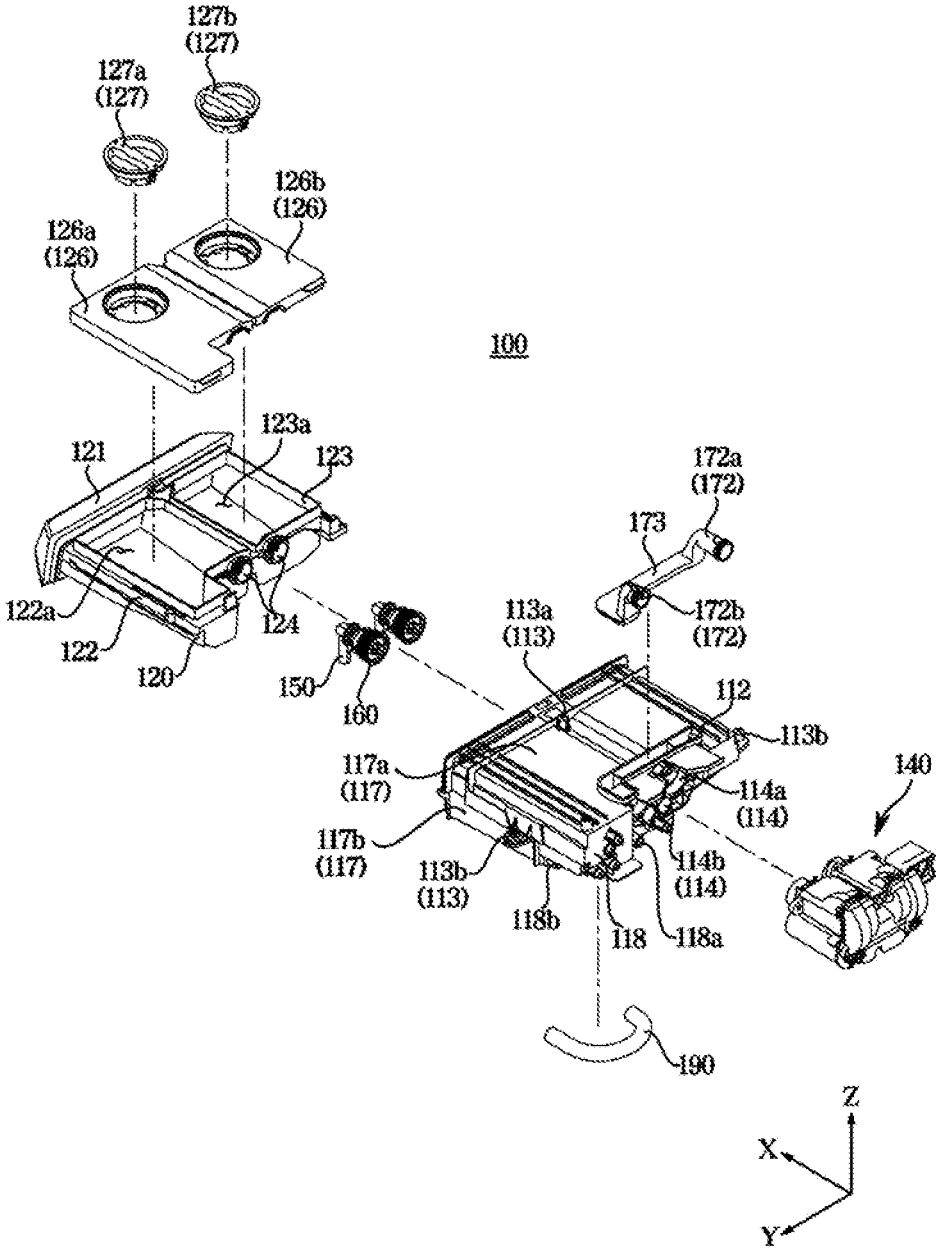
FIG. 7 is an exploded perspective view showing the detergent supply device in the clothes treatment apparatus shown in FIG. 5.

FIG. 5 is a perspective view showing the detergent supply device in the clothes treatment apparatus shown in FIG. 1. FIG. 6 is an exploded perspective view showing the detergent supply device in the clothes treatment apparatus shown in FIG. 5. FIG. 7 is an exploded perspective view showing the detergent supply device in the clothes treatment apparatus shown in FIG. 5. FIG. 7 is an exploded perspective view of the detergent supply device from a different angle than FIG. 6.

Referring to FIGS. 5 to 7, the clothes treatment apparatus according to an embodiment of the present disclosure may include the detergent supply device 100. The detergent supply device 100 may include the housing 110, a detergent container 120, the detergent pump 140, a pipe 150, a valve 160, the water supply guide 170, a flow guide 180, and a connection hose 190.

The housing 110 may accommodate the detergent container 120. For example, the housing 110 may accommodate a first container 122, a second container 123, and a detergent container cover 126. Because the detergent container 120 may accommodate detergent, detergent may be provided within the housing 110. The detergent container 120 may be placed in the receiving space 111 of the housing 110.

The housing 110 may include an opening 110*a*, the receiving space 111, a communication portion 112, a top cover fixing portion 113, and a detergent transfer portion 114.

The opening 110*a* may be formed in a front portion of the detergent container 120. The detergent container 120 may be pulled out from the receiving space 111 towards the inlet 13 through the opening 110*a*, or may be pulled in from the inlet 13 towards the receiving space 111. The opening 110*a* may be the front opening 110*a*.

The receiving space 111 may allow the detergent container 120 to be accommodated in the housing 110. The receiving space 111 may be formed by walls 117 and 118 of the housing 110. For example, the receiving space 111 may be formed by an upper wall 117*a*, side walls 117*b*, and a lower wall 117*c* of the housing 110. In addition, the receiving space 111 may also be covered by the rear wall 118 of the housing 110.

The communication portion 112 may be configured to communicate with the housing 110 and the water supply guide 170. The communication portion 112 may be formed on one wall of the housing 110. For example, the communication portion 112 may extend upwardly from the upper wall 117*a* of the housing 110. However, the present disclosure is not limited thereto, and the communication portion 112 may extend from the side wall 117*b* or the lower wall 117*c* of the housing 110 and may also extend from the rear wall 118. The communication portion 112 may form a communication port 112*a* opened in one wall of the housing 110. For example, the communication port 112*a* may be opened in the upper wall 117*a* of the housing 110. However, the present disclosure is not limited thereto, and the communication portion 112 may be opened in the side wall 117*b* or the lower wall 117*c* of the housing 110, or may be opened in the rear wall 118 of the housing 110. The communication portion 112 and/or the communication port 112*a* may be formed to correspond to the water supply guide 170.

The top cover fixing portion 113 may fix the detergent supply device 100 to the top cover 12. For example, the top cover fixing portion 113 may allow the housing 110 to be fixed to the top cover 12. The top cover fixing portion 113 may include a first fixing portion 113*a* and a second fixing portion 113*b*. The first fixing portion 113*a* may protrude upwardly from the upper wall 117*a* of the housing 110. The second fixing portion 113*b* may protrude laterally from the side wall 117*b* of the housing 110. The number and/or shape of the top cover fixing portions 113 may not be limited to those shown in the drawings.

The detergent transfer portion 114 may be configured such that when the detergent container 120 is docked with the detergent pump 140, detergent that may be accommodated in the housing 110 may be drawn from the inside of the detergent container 120 to the detergent pump 140 and then back into the housing 110. The detergent transfer portion 114 may be formed at a rear portion of the housing 110. For example, the detergent transfer portion 114 may be formed to penetrate the rear wall 118 of the housing 110. The detergent transfer portion 114 may include a first detergent transfer portion 114*a* and a second detergent transfer portion 114*b*. For example, when the detergent container 120 and the detergent pump 140 are docked, detergent in the housing 110 or the detergent container 120 may travel through the first detergent transfer portion 114*a* to the detergent pump 140 and then through the second detergent transfer portion 114*b* back into the housing 110.

The housing 110 may further include communication holes 118*a* and 118*b*. The communication holes 118*a* and 118*b* may be formed to penetrate the rear wall 118 of the housing 110. The communication holes 118*a* and 118*b* may include the first communication hole 118*a* and the second communication hole 118*b*. The first communication hole 118*a* and the second communication hole 118*b* may be connected by the connection hose 190. Water entering the housing 110 through the water supply guide 170 may flow into the first communication hole 118*a*. Water flowing through the first communication hole 118*a* may flow into the connection hose 190 provided outside the housing 110. Water flowing through the connection hose 190 may flow through the second communication hole 118*b* and flow back into the receiving space 111 within the housing 110. In other words, the receiving space 111 may also contain water. Water entering the receiving space 111 through the second communication hole 118*b* may pass through a lower portion of the housing 110 and flow into the tub 20 and/or the rotating tub 30.

A sensor (not shown) may be coupled to the rear wall 118 of the housing 110 to detect whether the detergent container 120 is accommodated in the housing 110 or whether the detergent container 120 is docked with the detergent pump 140.

The housing 110 may include a partition 180 that prevents water flowing into the housing 110 from the water supply guide 170 from flowing toward an upper side of the detergent container 120. The partition 180 may serve as the flow guide 180. The flow guide 180 may be provided within the housing 110. The flow guide 180 may be included in the detergent supply device 100. More details will be described later.

The detergent container 120 may be docked with the detergent pump 140. When the detergent container 120 is docked with the detergent pump 140, the detergent in the detergent container 120 may be discharged into the housing 110 through the detergent pump 140.

The detergent container 120 may be inserted into the receiving space 111 through the opening 110*a* of the housing 110 or withdrawn towards the inlet 13. The detergent container 120 may store main detergent (e.g., powder detergent or liquid detergent), pre-detergent, fabric softener, and/or bleach.

The detergent container 120 may include a front cover 121, the first container 122, the second container 123, a discharge portion 124, the detergent container cover 126, and a cap 127.

The front cover 121 may be disposed on a front side of any component of the detergent container 120. The front cover 121 may form a part of the inlet 13. The front cover 121 may form a gripping portion (see FIG. 9) on an inner side thereof for a user to grip the detergent container 120 to insert or remove the detergent container 120.

The first container 122 and/or the second container 123 may contain a main laundry detergent, a softener, and/or a rinse aid. For example, the first container 122 may contain a main laundry detergent, and the second container 123 may contain a fabric softener or pre-detergent. The first container 122 may be formed larger than the second container 123. However, the type of detergent to be contained and/or the size of the containers 122 and 123 may not be limited to the above examples. The first container 122 and the second container 123 may be disposed on a rear side of the front cover 121. The first container 122 may form a first region 122*a* and the second container 123 may form a second region 123*a*. For example, the first region 122*a* may contain a main laundry detergent, and the second region 123*a* may contain a fabric softener or pre-detergent.

The discharge portion 124 may be formed by opening in a rear portion of the first container 122 and a rear portion of the second container 123, respectively. A plurality of discharge portions 124 may be provided. The discharge portion 124 may allow the detergent contained in the first region 122*a* and/or the second region 123*a* to travel through the pipe 150 and the valve 160 to the detergent pump 140. For example, when the detergent container 120 and the detergent pump 140 are docked, the detergent may be moved to the detergent pump 140 via the discharge portion 124 and the first detergent transfer portion 114*a* and then back to the interior of the housing 110 via the second detergent transfer portion 114*b*. However, the location of the discharge portion 124 is not limited to that shown in the drawings.

The detergent container cover 126 may be configured to cover an upper portion of the containers 122 and 123. For example, the detergent container cover 126 may be configured to cover an upper end of the containers 122 and 123. The detergent container cover 126 may include a first detergent container cover 126*a*, which corresponds to the first region 122*a* and is configured to cover the upper portion of the first container 122, and a second detergent container cover 126*b*, which corresponds to the second region 123*a* and is configured to cover the upper portion of the second container 123.

The cap 127 may be coupled to the detergent container cover 126. The cap 127 may be removed when the user has finished adding detergent to the container. When the user completes adding detergent to the container, the cap 127 may be refitted to the detergent container cover 126. The cap 127 may include a first cap 127*a* and a second cap 127*b*. The first cap 127*a* may be fitted to the first detergent container cover 126*a*, and the second cap 127*b* may be fitted to the second detergent container cover 126*b*.

The detergent pump 140 may be disposed on a rear side of the housing 110 and the detergent container 120. The detergent pump 140 may be secured to the housing 110. When the detergent container 120 is inserted into the housing 110 and docked with the detergent pump 140, the detergent pump 140 may intake in the detergent in the detergent container 120 and discharge the intake detergent into the receiving space 111 in the housing 110. For example, when the discharge portion 124 of the detergent container 120 is docked with a first docking portion 141 of the detergent pump 140, the detergent accommodated in the detergent container 120 may move through the discharge portion 124 and the first transfer portion 114*a* and the first docking portion 141 into the detergent pump 140, and then move through the second docking portion 142 and the second transfer portion 114*b* into the receiving space 111 of the housing 110. The detergent entering the receiving space 111 may be mixed with water entering the housing 110 through the water supply guide 170. The water mixed with detergent may flow into the interior of the tub 20 and/or the interior of the rotating tub 30 along the lower wall 117*c* of the housing 110 which is inclined downwardly towards the front.

The pipe 150 may communicate with the detergent container 120 and the detergent pump 140. The pipe 150 may be disposed within the detergent container 120. For example, the pipe 150 may be positioned in the first region 122*a* or the second region 123*a*. Detergent may move to the detergent pump 140 through the pipe 150. For example, detergent may move to the detergent pump 140 through a detergent flow path 130 formed in the pipe 150.

The valve 160 may open and close the detergent flow path 130. The valve 160 may open and close the detergent flow path 130 to adjust an amount of detergent entering the detergent pump 140. The valve 160 may be disposed between the detergent container 120 and the detergent pump 140. For example, the valve 160 may be located between the detergent container 120 and the detergent pump 140 along the front-to-back direction.

An upper end of the valve 160 may be positioned higher than a lower end of the flow guide 180. For example, the flow guide 180 forming a guide channel 181 may extend to a lower position of the valve 160, so that water flowing into the housing 110 may flow steadily and without fluctuation to the lower portion of the housing 110.

The water supply guide 170 may guide water flowing into the tub 20 from the outside of the clothes treatment apparatus through the water supply pipe. The water supply guide 170 may be disposed on an upper side of the housing 110 and communicate with the communication portion 112. However, the location of the water supply guide 170 is not limited to the above example. The water supply guide 170 and the housing 110 may be thermally bonded. For example, a panel portion 173 of the water supply guide 170 and the communication portion 112 of the housing 110 may be thermally bonded.

A water supply channel 171 may be formed within the water supply guide 170. Further details will be described later.

The water supply guide 170 may include a pipe portion 172 and the panel portion 173. The pipe portion 172 may be disposed on an upper side of the panel portion 173. The pipe portion 172 may be connected to the water supply valve 15. The pipe portion 172 may be supplied with water outside the clothes treatment apparatus from the water supply pipe and the water supply valve 15, and may be supply the water into the housing 110. The pipe portion 172 may be connected to the panel portion 173.

The pipe portion 172 may include a first pipe portion 172*a* and a second pipe portion 172*b*. For example, the first pipe portion 172*a* may be disposed further forward than the second pipe portion 172*b*. In addition, for example, the first pipe portion 172*a* may be disposed further to the right of the second pipe portion 172*b*. In addition, for example, the first pipe portion 172*a* may be supplied with cold water, and the second pipe portion 172*b* may be supplied with hot water. However, the location, shape, and type of hot and cold water of the first pipe portion 172*a* and the second pipe portion 172*b* are not limited to the above examples.

The panel portion 173 may be disposed on a lower side of the pipe portion 172. The panel portion 173 may be in communication with the communication portion 112 of the housing 110. For example, the water supply channel 171 in the water supply guide 170 may be connected to the communication port 112*a* of the housing 110. In addition, the communication port 112*a* may be in communication with the guide channel 181 in the housing 110. Further details will be described later.

The connection hose 190 may connect the first communication hole 118*a* and the second communication hole 118*b* formed in the rear wall 118 of the housing 110. For example, the connection hose 190 may be configured to allow water discharged from the housing 110 through the first communication hole 118*a* to flow back into the housing 110 through the second communication hole 118*b*.

Figure 8:
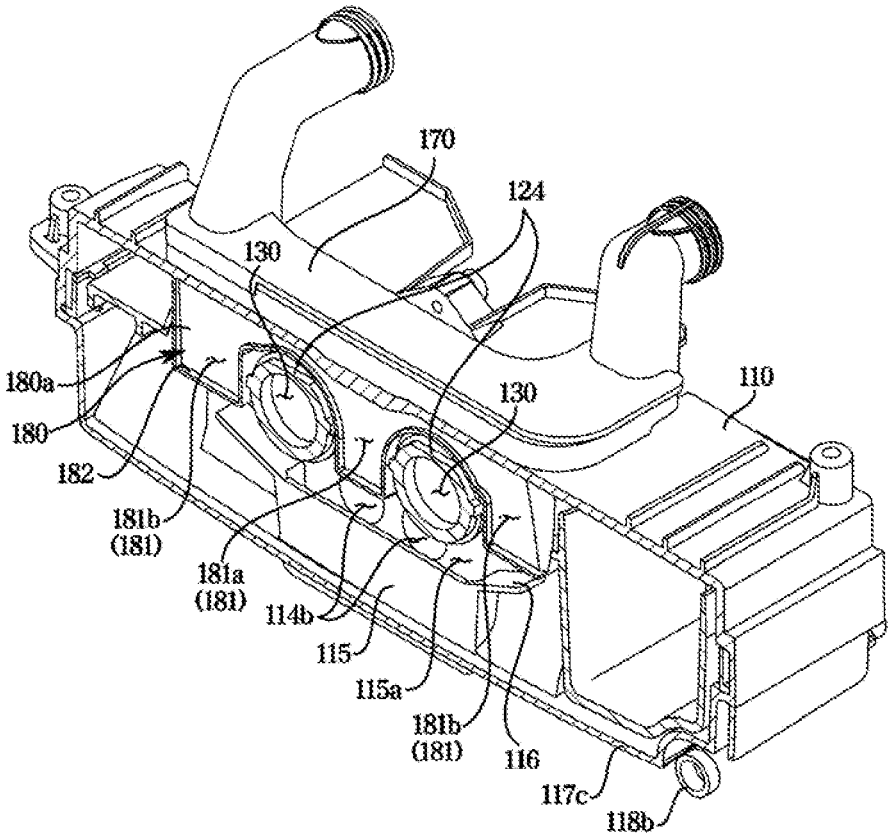
FIG. 8 is a cross-sectional view of the detergent supply device shown in FIG. 5.

FIG. 8 is a cross-sectional view of the detergent supply device shown in FIG. 5. FIG. 8 is a cross-sectional view taken along line A-A' of the detergent supply device shown in FIG. 5.

Referring to FIG. 8, the detergent supply device 100 may further include the detergent flow path 130. The detergent flow path 130 may be formed within the housing 110. The detergent flow path 130 may be formed within the pipe 150, the discharge portion 124, and the detergent transfer portion 114. Although not shown in FIG. 8, detergent may travel from the detergent container 120 to the detergent pump 140 through the detergent flow path 130.

The housing 110 may include a collecting case 115, a water collection guide 116, and the flow guide 180.

The collecting case 115 may be disposed on a lower portion of the flow guide 180. The collecting case 115 may be configured to collect water guided into the housing 110 through the water supply guide 170 and the flow guide 180. In addition, detergent that has passed through the detergent container 120 and the detergent pump 140 and returned to the housing 110 may be collected in the collecting case 115. The collecting case 115 may form a collecting space 115*a*. For example, the collecting space 115*a* may collect detergent and/or water. Accordingly, the detergent and water may be mixed with each other in the collecting space 115*a*. The collecting case 115 may extend upwardly from a lower end of the housing 110. For example, the collecting case 115 may extend upward from the lower wall 117*c* of the housing 110.

Figure 12:
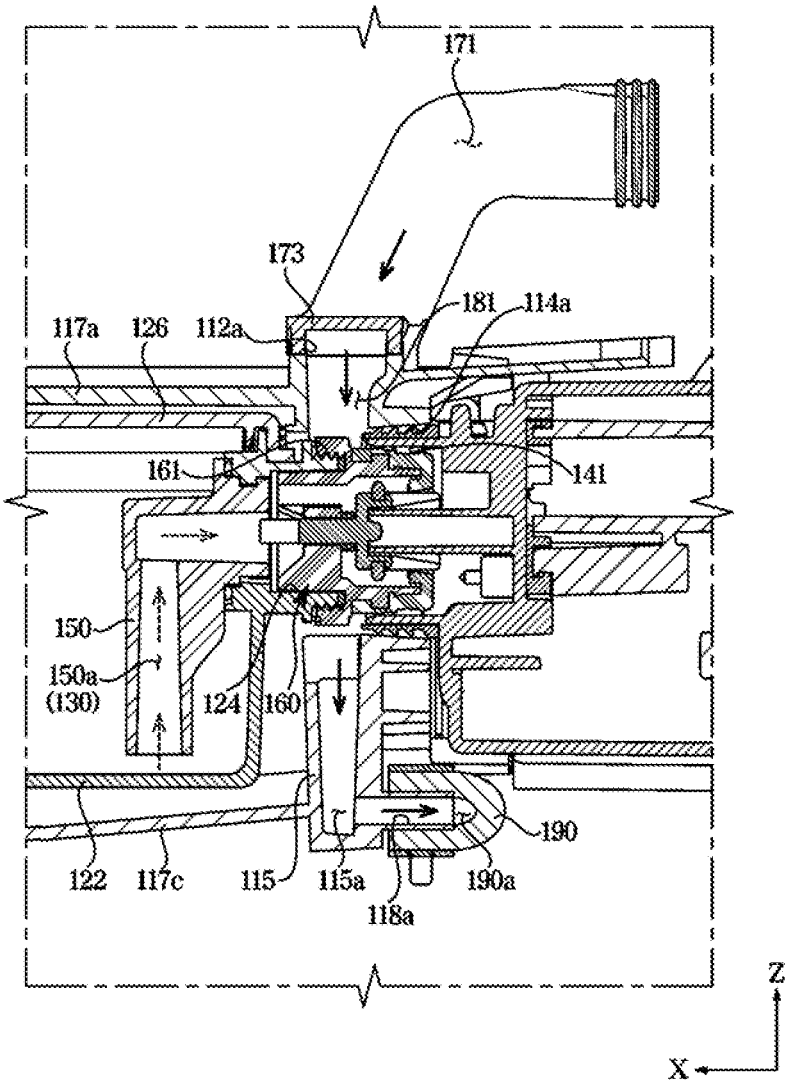
FIG. 12 is an enlarged view of the detergent supply device shown in FIG. 11.

The collecting space 115*a* may be connected to the first communication hole 118*a* (see FIG. 12). Accordingly, the water and detergent mixed in the collecting space 115*a* may flow to the outside of the housing 110 through the first communication hole 118*a* and the connecting hose 190, and then flow back into the receiving space 111, which is the inside of the housing 110, through the second communication hole 118*b*. The water mixed with detergent may then flow along the lower wall 117*c* of the housing 110 that is inclined downwardly in a forward direction, and may flow into the interior of the tub 20 and/or the rotating tub 30.

The water collection guide 116 may be connected to the collecting case 115. The collection guide 116 may slope downwardly toward the collecting case 115 such that water flowing through the guiding channel 181 provided within the flow guide 180 is collected in the collecting space 115*a*. The water collection guide 116 may be provided on opposite sides of the collecting case 115. The water collection guides 116 may allow water discharged from a side channel 181*b* to flow into the collecting space 115*a*.

The flow guide 180 may be configured to ensure that water entering the housing 110 through the water supply guide 170 to flow stably into the detergent container 120 without unexpectedly splashing. The flow guide 180 may be in communication with the water supply guide 170. The flow guide 180 may extend downward from an upper end of the housing 110. The flow guide 180 may extend lower than an upper end of the discharge portion 124. Accordingly, although water flowing through the guide channel 181 in the flow guide 180 encounters the valve 160, the water may be obstructed by the flow guide 180, thereby not splashing toward the detergent container 120. For example, because the water entering the housing 110 does not flow toward the detergent container cover 126, mold caused by residual water on the detergent container cover 126 may be minimized.

The flow guide 180 may be formed within the housing 110. Accordingly, the flow guide 180 may be included in the housing 110. The flow guide 180 may also be referred to as the partition 180.

The lower end of the flow guide 180 may be positioned lower than the upper end of the valve 160. For example, the flow guide 180 forming the guide channel 181 may extend to the lower position of the valve 160, so that water entering the housing 110 may flow stably without fluctuation to the lower portion of the housing 110.

The detergent container 120, the flow guide 180, and the detergent pump 140 may be arranged sequentially along the front-back direction. Therefore, the present disclosure may provide a clothes treatment apparatus including the detergent supply device 100 in which detergent is automatically supplied while compactly configuring the space inside the main body 2.

The flow guide 180 may form the guide channel 181. For example, the flow guide 180 may form the guide channel 181 between the flow guide 180 and the rear wall 118 of the housing 110. The guide channel 181 may be connected to the water supply channel 171 provided in the water supply guide 170 through the communication port 112*a*. The guide channel 181 may extend to a lower portion of the discharge portion 124, so that water entering the housing 110 may flow steadily to the lower portion of the housing 110 without fluctuating. The flow guide 180 may be formed to correspond to the shape of the discharge portion 124.

The guide channel 181 may include a middle channel 181*a* and side channels 181*b*. The middle channel 181*a* may be formed in a center portion. Water flowing through the middle channel 181*a* may flow into the collecting space 115*a*. The side channels 181*b* may be provided on opposite sides of the middle channel 181*a*. A portion of the water flowing through the side channels 181*b* may flow into the collecting space 115*a* through the water collection guide 116. The remaining portion of the water flowing through the side channels 181*b* may flow directly to the lower wall 117*c* of the housing 110 and into the tub 20 and/or the rotating tub 30.

Water entering the guide channel 181 may wash an upper outer wall 161 of the valve 160 and flow into the middle channel 181*a* or the side channels 181*b*.

The flow guide 180 may include a sealing rib 182 protruding forward from a front surface 180*a* of the flow guide 180. The sealing rib 182 may seal a space between the detergent container 120 and the flow guide 180 when the detergent container 120 is inserted into the housing 110. For example, the sealing rib 182 may seal the space between the detergent container 120 and the flow guide 180 when the detergent container 120 is docked with the detergent pump 140. The sealing rib 182 may protrude forward from a lower end of the front surface 180*a* of the flow guide 180.

Figure 9:
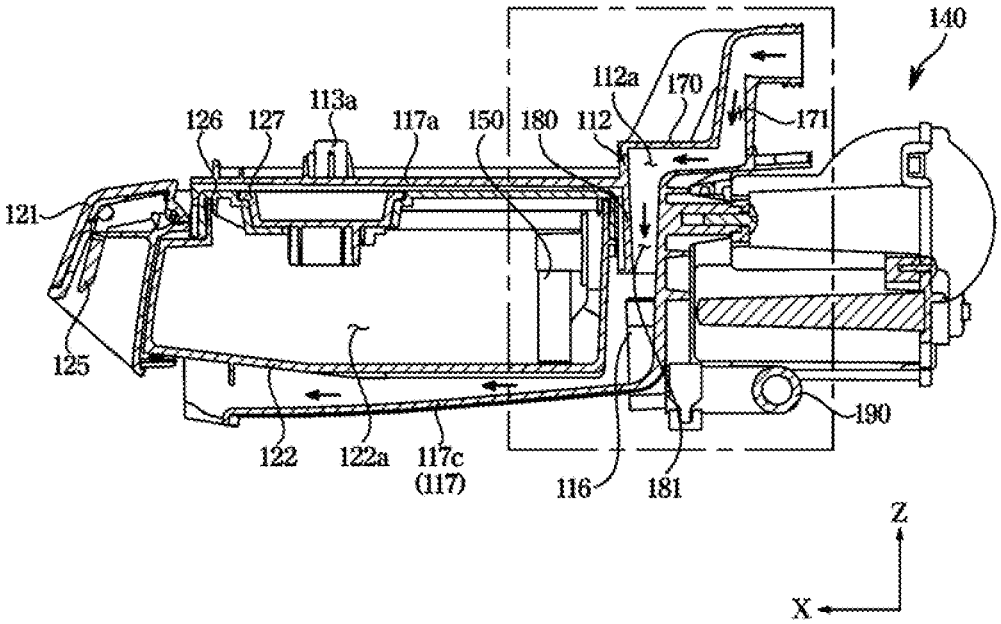
FIG. 9 is a cross-sectional view of the detergent supply device shown in FIG. 5.
Figure 10:
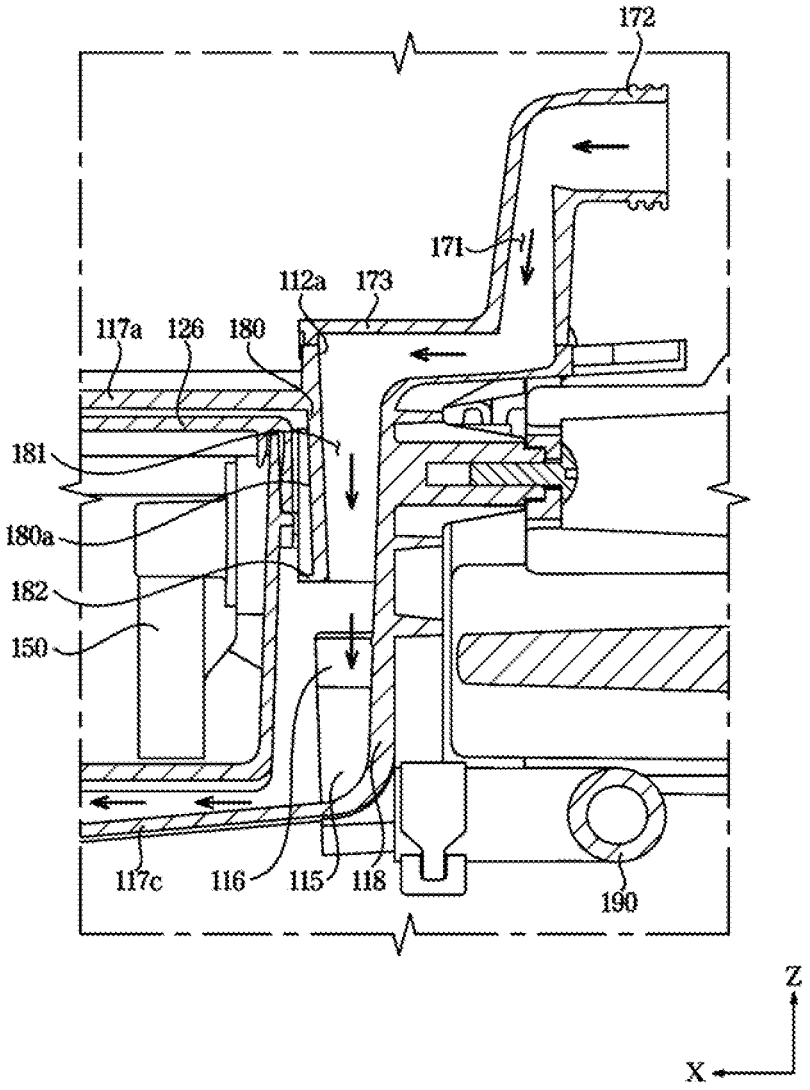
FIG. 10 is an enlarged view of the detergent supply device shown in FIG. 9.

FIG. 9 is a cross-sectional view of the detergent supply device shown in FIG. 5. FIG. 9 is a cross-sectional view taken along line B-B' of the detergent supply device shown in FIG. 5. FIG. 10 is an enlarged view of the detergent supply device shown in FIG. 9.

Referring to FIG. 9, in the clothes treatment apparatus according to an embodiment of the present disclosure, the detergent supply device 100 may include a locking member 125 disposed at the rear side of the front cover 121. The locking member 125 may be interlocked with another locking member (not shown) provided in the main body 2 to allow the detergent supply device 100 to be locked or unlocked to the main body 2.

Referring to FIG. 10, solid arrows show water flowing. Water may be introduced into the detergent supply device 100 through the pipe portion 172 of the water supply guide 170. Water entering the water supply guide 170 may flow through the water supply channel inside the water supply guide 170 and towards the communication portion 112, which is in communication with the panel portion 173. Water may flow downward, through the communication port 112*a*, and into the guide channel 181. Because the guide channel 181 extends downward, water in the guide channel 181 may flow to the lower portion of the housing 110 instead of flowing to the upper portion of the detergent container 120. For example, water entering the housing 110 may flow to the lower portion of the housing 110 without splashing onto the detergent container cover 126 due to the flow guide 180. Furthermore, a portion of the water guided by the flow guide 180 may be collected in the collecting space 115*a*, and the remaining portion of the water may flow directly to the lower wall 117*c* side of the housing 110. In this time, the guide channel 181 may be the side channels 181*b*. However, the guide channel 181 is not limited to the side channels 181*b*.

The sealing rib 182 may protrude forward from the lower end of the front surface 180*a* of the flow guide 180 to minimize splashing of water discharged from the guide channel 181 onto the upper side of the detergent container 120 under strong water pressure. In other words, the sealing rib 182 may minimize water flowing onto the upper side of the housing 110. The sealing rib 182 may be formed to correspond to a circumference of the valve 160. For example, the sealing rib 182 may be formed to correspond to the outer wall 161 of the valve 160.

However, the space between the flow guide 180 and the detergent container 120 may not be sealed or narrowed solely by the sealing rib 182. For example, the thickness of the flow guide 180, which is the partition, may be increased to prevent water from flowing over the upper portion of the housing 110.

Figure 11:
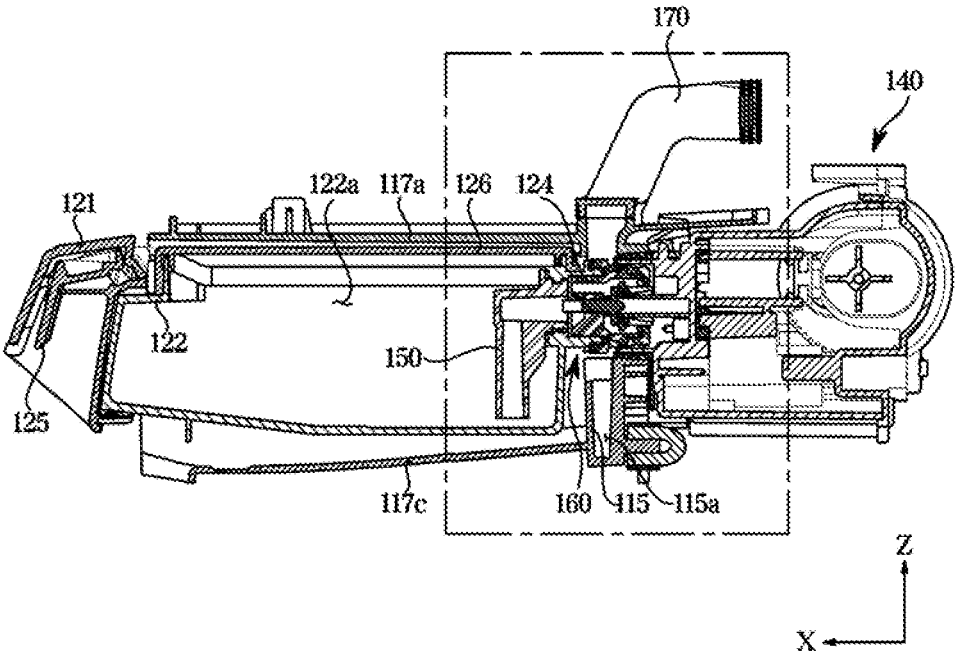
FIG. 11 is a cross-sectional view of the detergent supply device shown in FIG. 5.

FIG. 11 is a cross-sectional view of the detergent supply device shown in FIG. 5. FIG. 11 is a cross-sectional view taken along line C-C' of the detergent supply device shown in FIG. 5. FIG. 12 is an enlarged view of the detergent supply device shown in FIG. 11.

Referring to FIGS. 11 and 12, the solid arrows show water flowing. Water may be introduced into the detergent supply device 100 from the clothes treatment apparatus according to an embodiment of the present disclosure. Water entering the housing 110 through the water supply guide 170 may be guided by the flow guide 180, and thus the water may pass through the outer wall 161 side of the valve 160. For example, water flowing into the guide channel 181 may wash the outer wall 161 of the valve 160 and flow into the collecting space 115*a*. In the collecting space 115*a*, water or water mixed with detergent in the collecting space 115*a* may flow to the connection hose 190 through the first communication hole 118*a*. Through the connection hose 190, the water may flow into the second communication hole 118*b*. Accordingly, the solid arrow depicted within the first communication hole 118*a* shown in FIG. 12 may be water to be mixed with detergent.

The dashed arrows show detergent flowing. The detergent flow path 130 may be formed within the pipe 150, the discharge portion 124, and the detergent transfer portion 114. When the detergent container 120 and the detergent pump 140 are docked, detergent may flow to the detergent pump 140 through the detergent flow path 130, at which time the valve 160 may open or close the detergent flow path 130.

For example, when the detergent container 120 and the detergent pump 140 are docked or undocked, detergent may stick to the outer wall 161 of the valve 160. When water is introduced into the housing 110 through the water supply guide 170, the water passing through the guide channel 181 may flow in a top-to-bottom direction to wash away the detergent accumulated on the outer wall 161 of the valve 160.

The detergent and water collected in the collecting space 115*a* may flow into the second communication hole 118*b* through the first communication hole 118*a* and the connecting hose 190. For example, the detergent and water in the collecting space 115*a* may flow through the second communication hole 118*b* by way of a channel 190*a* in the connection hose 190 to the lower wall 117*c* of the housing 110. Since the lower wall 117*c* is inclined downwardly toward the front, the detergent and water flowing toward the lower wall 117*c* of the housing 110 may flow into the tub 20 and/or the rotating tub 30.

Figure 13:
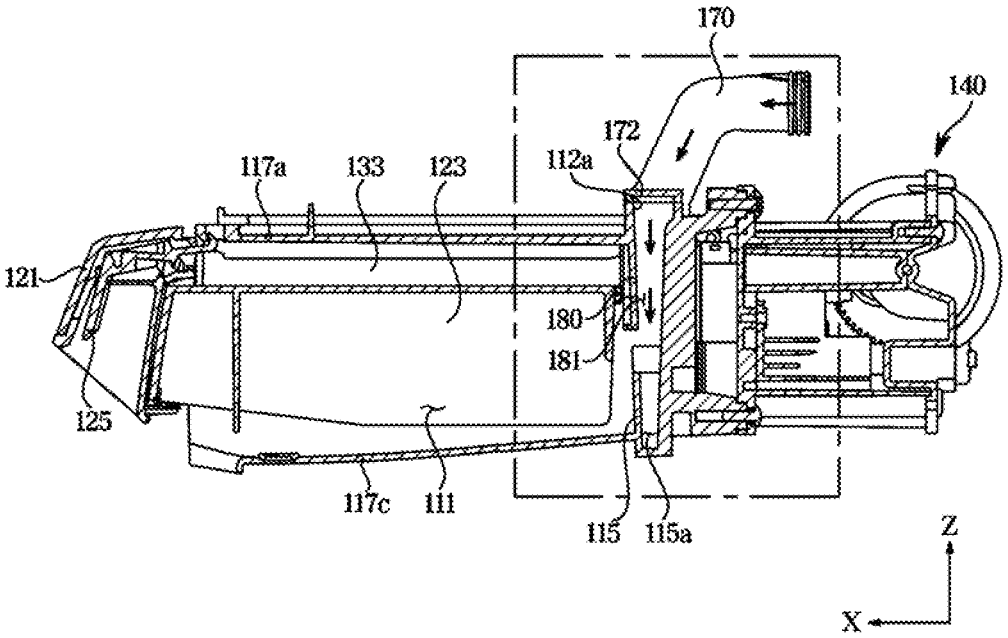
FIG. 13 is a cross-sectional view of the detergent supply device shown in FIG. 5.
Figure 14:
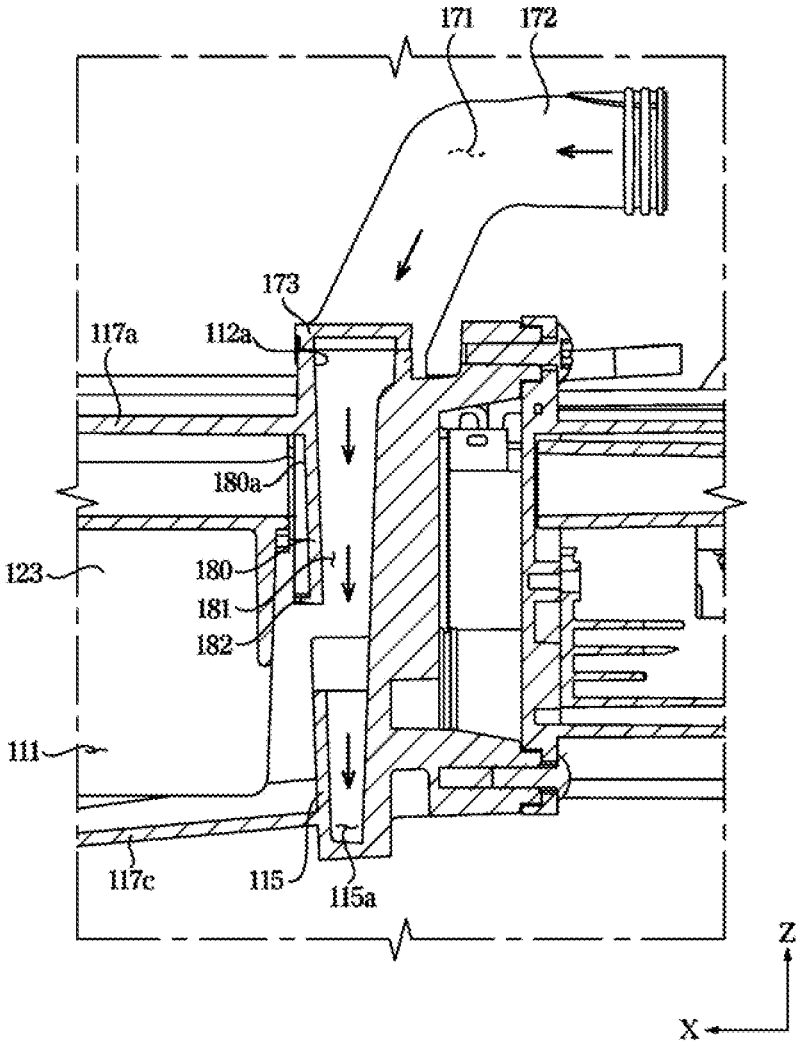
FIG. 14 is an enlarged view of the detergent supply device shown in FIG. 13.

FIG. 13 is a cross-sectional view of the detergent supply device shown in FIG. 5. FIG. 13 is a cross-sectional view taken along line D-D' of the detergent supply device shown in FIG. 5. FIG. 14 is an enlarged view of the detergent supply device shown in FIG. 13.

Referring to FIGS. 13 and 14, the solid arrows show water flowing. Water may be introduced into the detergent supply device 100 from the clothes treatment apparatus according to an embodiment of the present disclosure. Water entering the housing 110 through the water supply guide 170 may pass through the guide channel 181 and be collected in the collecting space 115*a* provided within the collecting case 115. In this time, the guide channel 181 may be the middle channel 181*a*.

As described above, the water collected in the collecting space 115*a* may flow into the second communication hole 118*b* through the first communication hole 118*a* and the connecting hose 190, and then flow back into the receiving space 111 and toward the lower wall 117*c* of the housing 110. Accordingly, the lower wall 117*c* is inclined downwardly toward the front, so that detergent and water flowing toward the lower wall 117*c* side of the housing 110 may flow into the tub 20 and/or the rotating tub 30.

While the present disclosure has been particularly described with reference to exemplary embodiments, it should be understood by those of skilled in the art that various changes in form and details may be made without departing from the spirit and scope of the present disclosure.

The invention claimed is:

1. A clothes treatment apparatus, comprising:
a cabinet;
a tub in the cabinet; and
a detergent supply device configured to supply detergent into the tub;
wherein the detergent supply device includes:
a housing,
a detergent container in the housing and configured to accommodate the detergent,
a detergent pump configured to intake the detergent accommodated in the detergent container and discharge the intaken detergent into the housing,
a pipe through which the detergent moves from the detergent container to the detergent pump when being intaken by the detergent pump,
a valve configured to open and close the pipe,
a water supply guide configured to guide water from a water supply source into the housing, and
a flow guide inside the housing, below the water supply guide, and forming a guide channel configured to guide the water supplied into the housing by the water supply guide downward to a lower portion of the housing to be mixed with the detergent discharged by the detergent pump into the housing, and to prevent the water from flowing upward to an upper side of the detergent container,
wherein the valve is partially disposed in the guide channel with an upper end of the valve being higher than a lower end of the flow guide such that the water being guided by the guide channel washes an outer wall of the valve.

2. The clothes treatment apparatus of claim 1, wherein the flow guide extends downward from an upper end of the housing.

3. The clothes treatment apparatus of claim 2, wherein the water supply guide is on an upper side of the housing.

4. The clothes treatment apparatus of claim 1, wherein
the detergent container includes a container configured to accommodate the detergent, and a detergent container cover covering an upper portion of the container, and
the flow guide extends downward from an upper end of the housing such that the water flowing into the housing is prevented from flowing to the detergent container cover.

5. The clothes treatment apparatus of claim 4, wherein
the detergent pump is on a rear of the housing.

6. The clothes treatment apparatus of claim 4, wherein
the guide channel includes a plurality of side channels and a middle channel between the valve and the plurality of side channels, and
the water being guided by the guide channel flows into the plurality of side channels or the middle channel after washing the outer wall of the valve.

7. The clothes treatment apparatus of claim 4, wherein
the flow guide includes a sealing rib protruding forward from a front surface of the flow guide to seal a space between the flow guide and the detergent container.

8. The clothes treatment apparatus of claim 7, wherein the sealing rib corresponds to a circumference of the valve such that the water flowing into the housing is prevented from splashing onto the detergent container cover.

9. The clothes treatment apparatus of claim 1, wherein the water supply guide includes:
a pipe portion configured to be supplied with the water from the water supply source, and
a panel portion communicating with the flow guide at a lower side of the pipe portion to allow water to flow from the pipe portion into the guide channel.

10. The clothes treatment apparatus of claim 9, wherein
the pipe portion is provided as a plurality of pipe portions, the plurality of pipe portions includes:
a first pipe portion connected to one end along a left-to-right direction of the panel portion, and
a second pipe portion connected to another end along the left-to-right direction of the panel portion and located further rearward than the first pipe portion.

11. The clothes treatment apparatus of claim 4, further comprising:
a top cover including an inlet at an upper portion of the top cover through which an object to be washed is receivable into the tub,
wherein the detergent supply device is above the tub to allow the detergent container to be pulled in from, or out of, the inlet.

12. A clothes treatment apparatus, comprising:

a cabinet;

a tub in the cabinet; and a detergent supply device configured to supply detergent into the tub;

wherein the detergent supply device comprises:

a housing, a container in the housing and configured to accommodate the detergent, a detergent container cover covering an upper portion of the container, a detergent pump to which the container is dockable, the detergent pump configured to intake the detergent from the container and discharge the intaken detergent into the housing based on the container being docked to the detergent pump, a pipe through which the detergent moves from the container to the detergent pump when being intaken by the detergent pump, a valve configured to open and close the pipe, a water supply guide configured to guide water from a water supply source into the housing, and a flow guide inside the housing, below the water supply guide, extending downward from an upper end of the housing, and forming a guide channel configured to guide the water supplied into the housing by the water supply guide downward to a lower portion of the housing to be mixed with the detergent discharged by the detergent pump into the housing, and to prevent the water from flowing into the detergent container cover, wherein the valve is partially disposed in the guide channel with an upper end of the valve being higher than a lower end of the flow guide such that the water being guided by the guide channel washes an outer wall of the valve.

13. The clothes treatment apparatus of claim 12, wherein the water supply guide is on an upper side of the housing.

* * * * *